United States Patent [19]

Jamieson

[11] 4,259,025

[45] Mar. 31, 1981

[54] IMPACT PRINTER WITH PLOTTING CAPABILITY

[75] Inventor: John W. Jamieson, San Leandro, Calif.

[73] Assignee: Qume Corporation, San Jose, Calif.

[21] Appl. No.: 947,008

[22] Filed: Sep. 29, 1978

[51] Int. Cl.[3] ..... B41J 29/26

[52] U.S. Cl. ..... 400/18; 400/208

[58] Field of Search ..... 400/16, 17, 18, 19, 400/20, 21, 22, 144.2, 144.3, 174, 175, 196.1, 208, 703

[56] References Cited

U.S. PATENT DOCUMENTS

| | | | |
|---|---|---|---|
| 1,397,740 | 11/1921 | Pereira | 400/18 |
| 2,582,412 | 1/1952 | Bosquet | 400/18 |
| 3,806,948 | 4/1974 | Nagao et al. | 400/17 X |
| 4,084,680 | 4/1978 | Deetz | 400/17 |

FOREIGN PATENT DOCUMENTS

| | | | |
|---|---|---|---|
| 2509840 | 9/1975 | Fed. Rep. of Germany | 400/208 |
| 304508 | 1/1933 | Italy | 400/20 |

OTHER PUBLICATIONS

IBM Technical Disclosure Bulletin, "Ribbon Cartridge", Mathews, vol. 18, No. 11, Apr. 1976, p. 3538.

*Primary Examiner*—Ernest T. Wright, Jr.
*Attorney, Agent, or Firm*—Thomas L. Peterson

[57] ABSTRACT

An impact printer, for example, of the daisy wheel type with plotting capability is provided by utilizing a cartridge which instead of an inked ribbon has a marking pen mounted through the cross-section of the cartridge and is selectively engageable against the paper by the use of the existing ribbon lift mechanism.

4 Claims, 4 Drawing Figures

IMPACT PRINTER WITH PLOTTING CAPABILITY

BACKGROUND OF THE INVENTION

The present invention is directed to an impact printer with plotting capability and more specifically to an impact printer which has a removable cartridge.

Impact printers of, for example, the daisy wheel type or the ball type (manufactured by IBM) have been used in the past for plotting of graphs or other figures since they are, of course, capable of being digitally controlled either by a computer tape or program. This produced an adequate plot but, in the case of the daisy wheel type of impact printer, required actuation of the printing hammer for each discrete dot, and produced a final plot made up of discrete dots which were visible to the eye.

OBJECTS AND SUMMARY OF THE INVENTION

It is, therefore, a general object of the present invention to provide an improved impact printer with plotting capability.

In accordance with the above object there is provided a printer with digitally controlled plotting capability which has a printing medium and a type carrier relatively movable relative to the printing medium and normally has a removable cartridge carrying an inked ribbon or the like for responding to the impact of the type to print on the medium. The present invention provides a cartridge which is substantially interchangable with the ribbon cartridge but includes means for marking the medium which is selectively movable into continuous contact with it.

DETAILED DESCRIPTION OF PREFERRED EMBODIMENT

Figure 1:
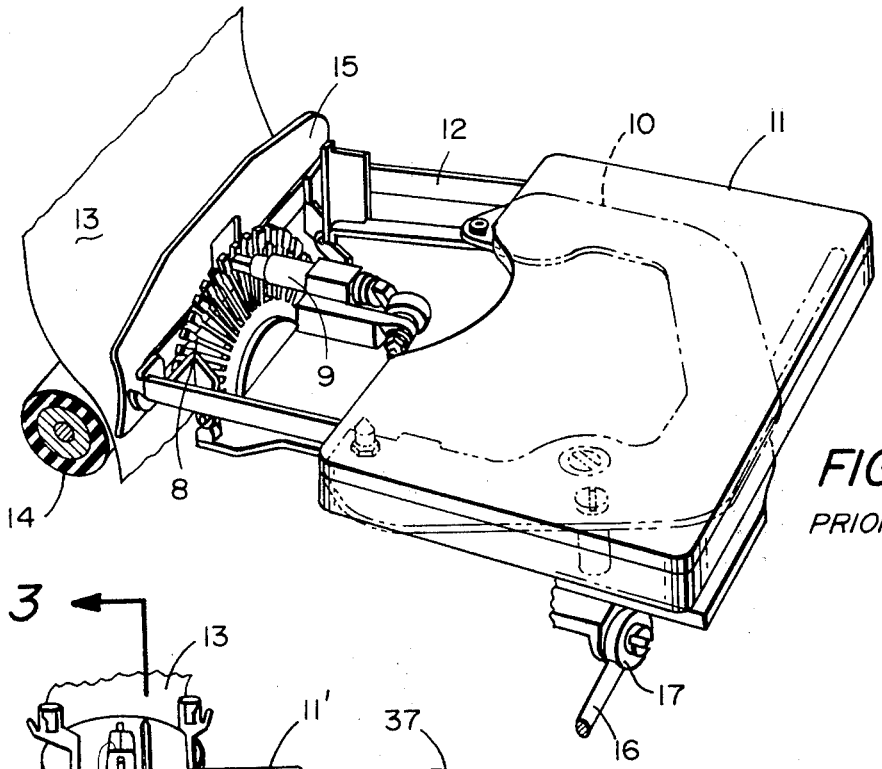
FIG. 1 PRIOR ART
FIG. 1 is a fragmentary perspective view partially in phantom of a prior art impact printer.

FIG. 1 illustrates a typical impact printer which in this specific case is of the daisy wheel type as shown by the daisy wheel 8 and the associated hammer 9. A platform 10 supports a ribbon cartridge 11 (shown in phantom), the cartridge 11 supplying an inked ribbon 12 in a position between the daisy wheel 8 and the printing medium or paper 13. The paper 13 is, of course, movable on a roller or rubber platen 14 and retained by necessary guides such as 15 against the platen 14. Platform 10 is actually a part of a movable carriage which moves on a shaft 16 and the rotatable support member 17. Thus, as illustrated in FIG. 1 this is what is termed a fixed platen typewriter which positions the printing elements or specifically the daisy wheel 8 with respect to the proper column of printing desired. Thus, the relative movement is produced by the carriage. However, in some applications the platen could move longitudinally along its axis rather than the carriage which has the print wheel. Since cartridge 11 contains the inked ribbon 12 which is used up, it is, of course, removable.

Figure 2:
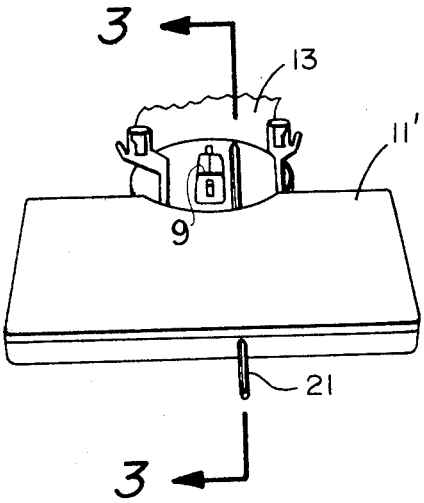
FIG. 2 is a perspective view showing the improvement of the present invention.

In accordance with the invention and referring to FIG. 2 in place of a typical cartridge 11 containing an inked ribbon 12 there is provided a cartridge 11' carrying marking means such as a ball point pen 21 which can selectively engage the paper 13. There would, of course, preferably be no ribbon in the cartridge 11' so as not to interfere with the pen 21. Alternatively, the pen 21 could be located above ribbon 12.

Figure 3:
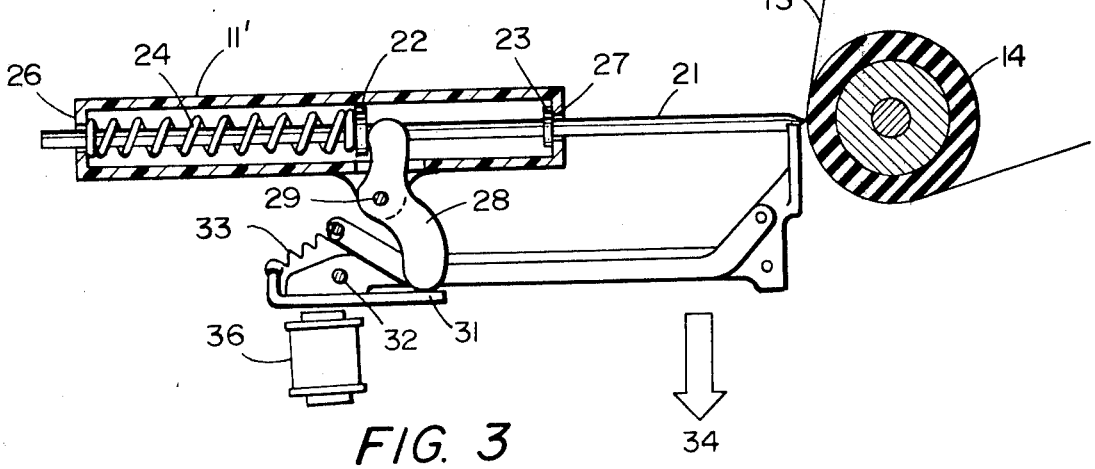
FIG. 3 is a cross-sectional view substantially along the line 3—3 of FIG. 2.

FIG. 3 illustrates the mechanical details of the marking pen 21 where it extends through the width dimension of the cartridge 11' and includes a first collar 22 and a second collar 23. The first collar 22 retains a concentric spring 24 against the left end 26 of the cartridge 11' to provide a force which tends to move the pen 21 toward the paper 13 and platen 14. Limitation of this movement so that the tip of the pen 21 is just touching the paper 13 is provided by the collar 23 which abuts the right end 27 of the cartridge 11' in the marking position.

Figure 4:
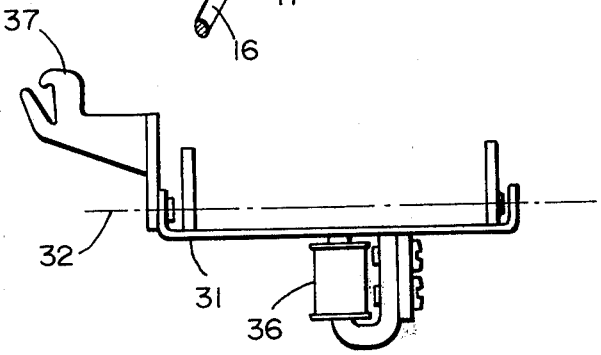
FIG. 4 is a more detailed elevation view of partial simplified portions of FIGS. 2 and 3.

Finally in order to allow the pen 21 to be lifted from the paper 13 at appropriate times as determined by the plotting instructions, a bell crank 28 mounted on an axis 29 is responsive to movement of the ribbon lift bail 31 of the impact printer. Such axis 29 could be affixed to the cartridge 11' as illustrated. The ribbon lift bail 31 is an existing component on a daisy wheel type impact printer which has the purpose of lifting the ribbon 12 in front of the daisy wheel type elements when printing is actually occuring or lowering the ribbon 12 to expose the line of printing for viewing. The ribbon lift bail components which are all old in the art, of course, include its pivot axis 32, the spring 33 which exerts a force in the direction shown by arrow 34 and a ribbon lift solenoid 36 which retains it in the opposite direction. Solenoid 36 and the ribbon lift bail 31 are shown in an orthogonal view in FIG. 4 in conjunction with a ribbon guide 37 which would not actually be used in this particular situation.

From an operational point of view, the pen 21 of the present invention provides for smooth plotting graphics (as opposed to dots), does not require repetitious actuation of the printing hammer 9, thereby increasing plotting speed and matches the existing digitally controlled plotting capabilities of the printer specifically in that both the indexing of the platen 14 and the movement of the carriage containing the printing elements have been controlled in the past by appropriate computer programs to provide plotting.Only a slight change need be made in the program to substitute a ribbon lift instruction where a gap in the plotted graphics is desired.

Thus an improved impact printer with plotting capability has been provided.

What is claimed is:

1. A printer which includes a ribbon lift mechanism and a pen linked to said mechanism for contacting a medium in response to the operation of said ribbon lift mechanism.

2. A cartridge for temporary installation in a printing apparatus, said printing apparatus printing on a printing medium and including means for temporarily receiving said cartridge and means for operating a movable member, said cartridge comprising:

(a) a housing;

(b) a marking pen movably mounted on said housing; and (c) means responsive to the operation of said movable member for moving said pen in and out of contact with said medium.

3. The cartridge according to claim 2, wherein said cartridge includes a spring to urge said pen towards said medium.

4. The cartridge according to claim 2 wherein said printing apparatus includes a ribbon lift mechanism and wherein said movable member comprises at least a portion of said lift mechanism.

* * * * *